US007156203B2

(12) United States Patent
Vanluffelen

(10) Patent No.: US 7,156,203 B2
(45) Date of Patent: Jan. 2, 2007

(54) DEVICE AND METHOD FOR EVACUATING PERSONS, FOR EXAMPLE FROM A MULTI-STOREY BUILDING ON FIRE

(76) Inventor: Lodewijk Vanluffelen, Achtelsestraat 98, B-2320 Hoogstraten (BE)

( * ) Notice: Subject to any disclaimer, the term of this patent is extended or adjusted under 35 U.S.C. 154(b) by 318 days.

(21) Appl. No.: 10/220,945

(22) PCT Filed: Mar. 9, 2001

(86) PCT No.: PCT/BE01/00042

§ 371 (c)(1),
(2), (4) Date: Oct. 22, 2002

(87) PCT Pub. No.: WO01/66192

PCT Pub. Date: Sep. 13, 2001

(65) Prior Publication Data

US 2003/0141145 A1 Jul. 31, 2003

(30) Foreign Application Priority Data

Mar. 9, 2000 (BE) ..... 2000/0187

(51) Int. Cl.
*A62B 5/00* (2006.01)

(52) U.S. Cl. ..... 182/10; 182/142; 244/31

(58) Field of Classification Search ..... 182/10, 182/11, 150, 142; 244/31, 32, 33
See application file for complete search history.

(56) References Cited

U.S. PATENT DOCUMENTS 293,322 A * 2/1884 Griswold
2,449,813 A 9/1948 Lawson ..... 244/24
4,421,204 A 12/1983 Lawrence ..... 182/50
4,932,606 A 6/1990 Conn ..... 244/33
4,934,277 A * 6/1990 Smith
5,042,748 A 8/1991 Conn ..... 244/33
5,058,831 A 10/1991 Takahashi ..... 244/142

FOREIGN PATENT DOCUMENTS

AT 353 615 6/1990
WO 92/06002 4/1992

* cited by examiner

*Primary Examiner*—Alvin Chin-Shue
(74) *Attorney, Agent, or Firm*—Dykema Gossett PLLC

(57) ABSTRACT

Device for evacuating persons, for example from a multi-storey building on fire, from an evacuating location to a secure location, comprising: a balloon provided to be filled with a gas lighter than air for moving the balloon between the secure location and the evacuating location; guide means connected to the balloon for guiding the balloon between the secure location and the evacuating location; and transport means connected to the balloon for transporting persons from the evacuating location to the secure location; wherein the device further comprises a cable provided to be connected between the secure location and the evacuating location and that the balloon is provided to be movably mounted on the cable between the secure location and the evacuating location.

18 Claims, 3 Drawing Sheets

DEVICE AND METHOD FOR EVACUATING PERSONS, FOR EXAMPLE FROM A MULTI-STOREY BUILDING ON FIRE

BACKGROUND OF INVENTION a. Field of Invention

The present invention relates to a device for evacuating persons, for example from a multi-storey building on fire, according to the preamble of the first claim.

b. Description of Related Art

A device for evacuating persons is for example known from U.S. Pat. No. 4,421,204. The device disclosed in this document comprises a balloon which in use is inflated with a gas lighter than air, a gondola connected to the bottom of the balloon and four guide wires connecting the gondola to a vehicle. The guide wires are provided to guide the balloon to a location for evacuating persons. The gondola is provided with two baskets in which persons to be evacuated can take place. Each basket is hung on a cable, by means of which the basket can be lowered from the gondola, so that persons can be evacuated from a high location without lowering the balloon and the gondola. The four guide wires and the two cables are all wound on winches provided on the vehicle. In use, the vehicle is placed on a secure location, after which the balloon is inflated and made to rise to the evacuating location by veering the guide wires and the basket cables in a controlled manner. Persons are evacuated by placing them in the baskets, after which the baskets are lowered while the balloon and the gondola remain at the evacuating location.

The device described in U.S. Pat. No. 4,421,204 however has the disadvantage that it is difficult to operate. The reason for this is that in order to guide the balloon to a location for evacuating persons, all winches of the guide wires and the basket cables have to be operated simultaneously. Furthermore, the use of the gondola with the baskets results in a heavy construction, which requires a large balloon in order to provide sufficient lifting force, which makes the balloon sensitive to wind.

SUMMARY OF INVENTION

It is an aim of the present invention to provide a device for evacuating persons which can be operated more easily.

This aim is achieved according to the invention with a device showing the characteristics of the characterizing part of claim 1.

The device according to the invention comprises a cable which is connectable between the secure location and the evacuating location. The balloon, with the transport means connected to it, is provided to be movably mounted along the cable between the secure location and the evacuating location. This construction makes it possible to load persons onto the transport means on the evacuating location, after which the balloon and the transport means can be moved along the cable to the secure location. As the cable remains connected to the evacuating location, it is simple to let the balloon ascend back to the evacuating location after the persons have been removed from the transport means on the secure location. In this way, the use of the gondola with baskets for evacuating persons can be avoided, which results in a lighter construction, a balloon of smaller dimensions and an easier operation of the device. Furthermore, as the balloon is provided to travel along the cable, substantially no steering or guiding of the balloon is required when the balloon moves between the evacuating location and the secure location.

The device according to the invention can be used in evacuating persons from a high storey of a multi-storey building on fire, or in evacuating persons who are trapped on a mountain, or any other evacuating operations in which persons have to be brought from an evacuating location to a secure location.

When used for evacuating persons from a building on fire, the secure location is preferably chosen at a given distance from a building. In this way, the cable connecting the secure and evacuating locations extends under a given angle with the horizontal. As a result, when persons are brought from the evacuating location to the secure location, they are immediately moved away from the building, and reach the ground at a distance from the building. So the persons are brought into safety more quickly than when they are simply lowered in substantially vertical direction, as is the case with the baskets in the prior art device. Furthermore, as the persons are immediately moved away from the building, the device of the invention is useable for evacuating persons from a high storey above a storey on fire. The device of the invention can however also be used in narrow streets, where the secure location is located closer to the building and the persons are transported in substantially vertical direction.

Using the balloon for evacuating persons has the advantages that, as the balloon can be inflated in a short time, the device of the invention can be rigged up quickly and evacuation can start after only a short period of time. Furthermore, by using the balloon, the height to which evacuation can be conducted is only limited by the length of the cable, so that the evacuation of persons can be conducted from great heights.

In a preferred embodiment of the device according to the invention, the transport means are provided to carry a weight which is sufficient to make the balloon descend. This means that the balloon will descend when the number of persons on the transport means is n or more and ascend when the number of persons is less than n. In this way, the evacuation of the persons can be conducted autonomously, i.e. with the descent resulting from earth gravitation and the ascent resulting from the lifting force of the gas in the balloon. In this way the use of moving means, such as for example a cable for pulling the balloon from the evacuating location to the secure location, can be avoided. Furthermore, as the lifting force of the gas in the balloon counteracts the gravitation and thus reduces the descending speed of the balloon, the persons can be steadily brought to the secure location. This also has the advantage that, if the cable should break during transportation of n or more persons from the evacuating location to the secure location, the balloon will continue to descend, so that the risk that the balloon flies away is reduced. So with the device according to the invention an increased safety of the persons being evacuated can be obtained.

The amount of lifting force which is provided by the gas inside the balloon during use depends on the weight of the gas at atmospheric pressure, i.e. on the gas which is used, and the gas volume of the balloon. In the device of the invention, these parameters are chosen such that the weight of n persons is sufficient to make the balloon descend.

The balloon is preferably provided to move along the cable by means of a wheel. This wheel is preferably provided with a brake for restricting the movement of the balloon along the cable. In this way, the ascending or descending speed of the balloon can be reduced, which can further increase the safety of the persons being transported.

In a preferred embodiment of the device according to the invention, the balloon has a flat side constructed in an inflammable material and comprises a number of compartments. During use, the flat side is provided to remain substantially vertical and to be directed towards a side wall of a building to be evacuated. In this way, the balloon can be brought closer to the side wall of the building, which makes it easier for a fireman to connect the cable to the evacuating location after the first ascent of the balloon, and also facilitates the loading of persons onto the transport means. The inflammable material reduces the risk that the flat side of the balloon catches fire during the evacuation of persons of a building on fire. The compartments of the balloon have the advantage that, should one of the compartments spring a leak, the other compartments remain intact and filled with the gas, so that the risk of a crash of the balloon can be reduced.

The guide means for guiding the balloon preferably comprise a pair of propellers located on either side of the balloon when in use. The propellers make it possible to steer the balloon towards the evacuating location and to maintain the flat side of the balloon directed towards the side wall of the building. Providing the propellers can increase the maneuverability of the balloon and reduce the dependency on weather conditions.

The propellers are preferably provided to be driven by means of pressurized air. This is advantageous as it is easy for a fireman hanging on the balloon to carry one or more bottles of pressurized air on his back, which he can connect to the propellers and thus himself steer the balloon. The propellers may however also be electrically driven or in any other way known to the person skilled in the art.

The propellers can be mounted on the balloon in a fixed way, or they can be rotatably mounted in order to further increase the maneuverability of the balloon.

The guide means preferably further comprise a pair of guide wires connected to either side of the balloon when in use and each provided to be operated by a person on the ground. By means of these guide wires, additional steering can be applied to the balloon by firemen on the ground. This further increases the maneuverability of the balloon and further reduces the dependency on weather conditions. Providing the guide wires further has the advantage that, in case the cable breaks, the balloon can be safely guided to the ground, which increases the safety of the persons being evacuated.

In a preferred embodiment of the device according to the invention, it further comprises a vehicle for transport to the secure location, the vehicle being provided with inflating means for inflating the balloon and a winch for rolling up or veering the cable. In this way, the device can be quickly transported to a place where evacuation of persons is required, where it can then quickly be rigged up for use.

The invention also relates to a method of evacuating persons from an evacuating location to a secure location according to claim 9. This method comprises the following steps. First, a balloon is inflated with a gas lighter than air. Then, the balloon is made to ascend by veering a cable which connects the balloon to the secure location, during which the balloon is guided to the evacuating location by means of guide means connected to the balloon. When the balloon has arrived on the evacuating location, the cable is connected to the evacuating location and a number of persons are placed on transport means connected to the balloon. The number of persons is chosen such that the total weight of the balloon, transport means, guide means and persons is larger than the lifting force resulting from the gas in the balloon. Finally, the persons are transported from the evacuating location to the secure location by letting the balloon descend along the cable. With the method according to the invention, the persons on the transport means can be safely transported to the secure location, as was already mentioned above when referring to the device of the invention.

The method according to the invention can be expanded by letting the balloon ascend back along the cable to the evacuating location, after the persons are removed from the transport means on the secure location. In this way, a large number of persons can be quickly evacuated from the evacuating location by letting the balloon ascend and descend repeatedly.

BRIEF DESCRIPTION OF THE DRAWINGS

The invention will be further elucidated by means of the following description and the appended figures.

DETAILED DESCRIPTION OF THE PREFERRED EMBODIMENTS

Figure 1:
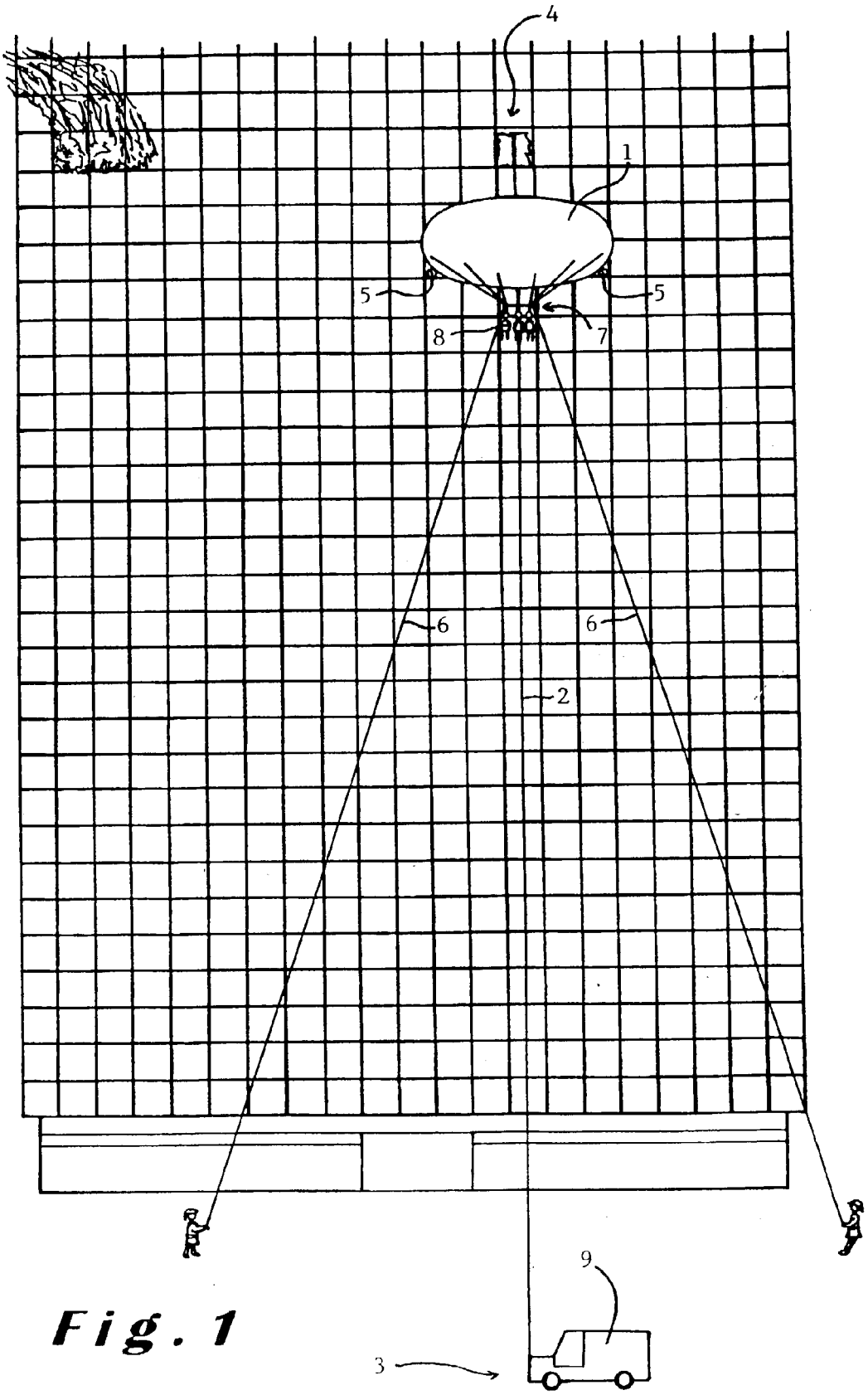
FIG. 1 shows the device of the invention in use in evacuating persons from a building on fire.

The device shown in FIG. 1 comprises a balloon 1 which is filled with a gas lighter than air. The balloon 1 is movable along a cable 2 of which one end is connected to a secure location 3 and the other end is connected to an evacuating location 4. Guide means 5, 6 are connected on either side of the balloon for guiding the balloon between the secure location 3 and the evacuating location 4. Transport means 7 are connected to the bottom side of the balloon 1, by means of which persons 8 can be transported from the evacuating location 4 to the secure location 3.

The transport means 7 are provided to carry a weight which is sufficient to make the balloon 1 descend. This sufficient weight is the weight of n persons, so that the balloon 1 descends when the number of persons on the transport means 7 is n or more and ascends when the number of persons is less than n. In the device of FIG. 1, n equals three, but n may also be more or less. In this way, the descent results from the total weight of the balloon 1, guide means 5, 6, transport means 7 and n or more persons 8 being larger than the lifting force of the gas in the balloon. As the balloon 1 can still ascend if the number of persons 8 on the transport means 7 is below n, a person can also be transported with the balloon from the secure location to the evacuating location. This is advantageous in evacuating operations on a building on fire, as this makes it possible to transport one or more firemen up to the evacuating location, who can assist in the evacuation or help to extinguish fire.

The guide means connected to the balloon 1 comprise propellers 5 and guide wires 6. The propellers 5 are preferably provided to be driven by means of pressurized air, which can for example be supplied from an air bottle carried by a fireman on the transport means, or from an air supply on the ground via an air duct. The propellers may however also be electrically driven, the electricity then being supplied by a battery connected to the propellers or from the ground, or they may be driven in any other way known to the person skilled in the art. The guide wires 6 have a substantial length, so that they can be held by a person on the ground, who can apply additional steering to the balloon by pulling or releasing the guide wires 6. By means of the guide wires 6, it can also be ensured that the balloon 1 descends safely to the ground in case the cable 2 should break or unintentionally come loose from the evacuating location 4.

The device shown in FIG. 1 further comprises a vehicle 9, by means of which the device can be transported to a place where evacuation is needed in a short time. The vehicle 9 is preferably provided with inflation means (not shown) for inflating the balloon and a winch (not shown) for rolling up and veering the cable 2.

Figure 2:
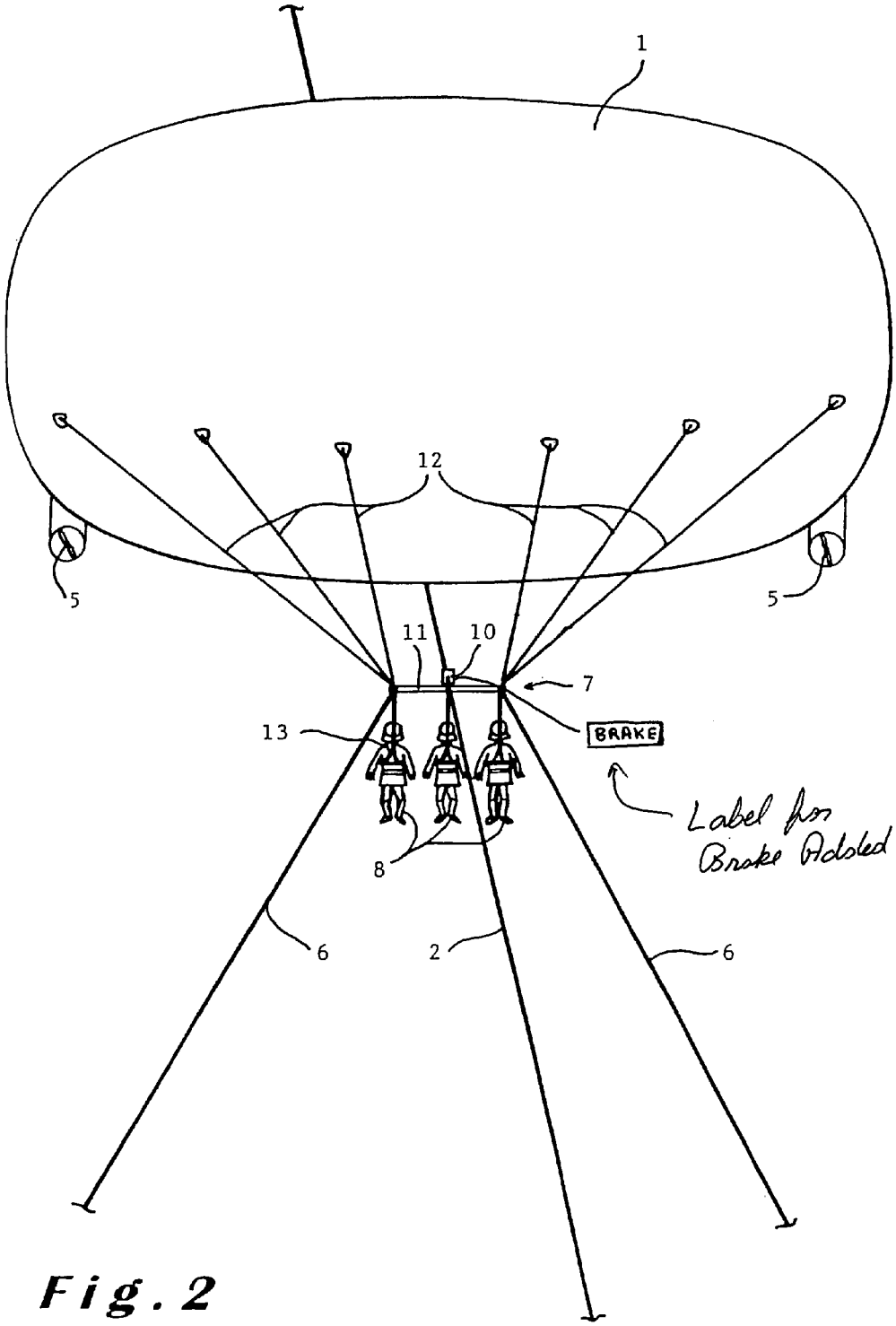
FIG. 2 shows a detail of the balloon of the device according to the invention in use.

In the detail of the device shown in FIG. 2 it can be seen that the balloon 1 is provided to move along the cable by means of a wheel 10, which is preferably provided with a brake (not shown) by means of which the speed with which the balloon 1 travels along the cable 2 can be limited. In this way, the safety of the persons 8 being evacuated can be enhanced.

The transport means 7 preferably comprise a bar 11 which is hung from the balloon 1 with a set of wires 12. From the bar, a number of belts 13 are hung, by means of which the persons 8 to be evacuated can be connected to the balloon 1. The guide wires 6 are preferably connected to the ends of the bar 11. The transport means may however also be constructed in any other way known to the person skilled in the art. If necessary, for example for evacuating a wounded person, a stretcher can be attached to the transport means.

Figure 3:
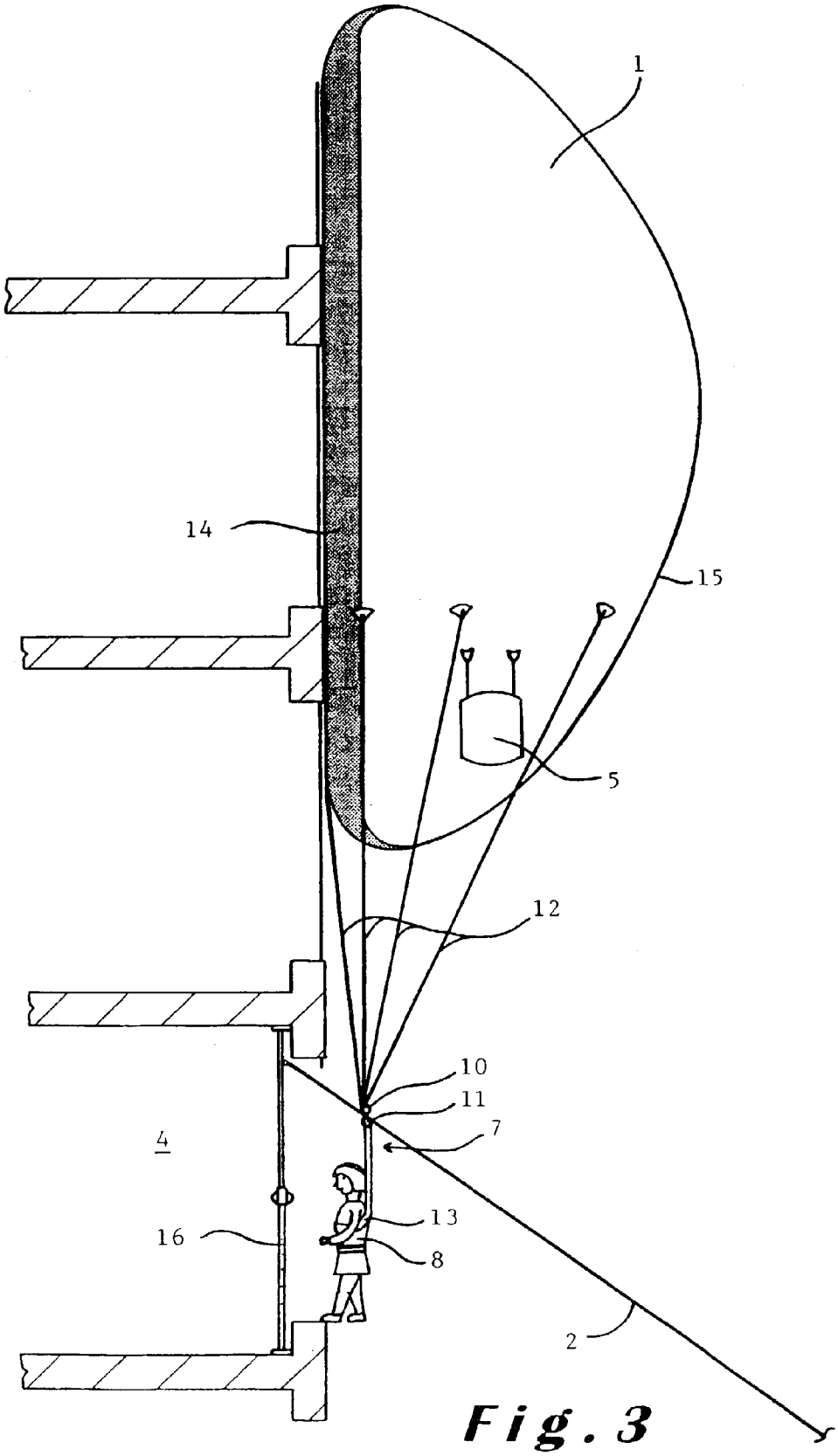
FIG. 3 shows a side view of the device according to the invention in use in evacuating persons from a building on fire.

The balloon 1 preferably has a shape comprising a flat side 14 and a convex side 15, as shown in FIG. 3. The flat side 14 is preferably substantially oval, as is shown in FIG. 2. This shape of the balloon 1 makes it possible to bring the transport means 7 very near to a building, so that a firemen can easily connect the cable 2 to the evacuating location 4 after the first ascent of the balloon 1 and so that the connecting of persons 8 to the balloon 1 is facilitated.

The flat side 14 is preferably constructed in a rigid and inflammable material, for example kevlar or other, so that the risk of the flat side 14 catching fire or being damaged is reduced. The balloon 1 is preferably divided into a number of compartments (not shown), so that a sufficient amount of gas remains in the balloon even if one of the compartments has sprung a leak. The flat side 14 preferably has rounded edges in order to reduce the risk that the balloon gets stuck behind an obstruction on the side wall of the building.

The gas used for inflating the balloon 1 is preferably an inert gas, preferably helium, which is preferably supplied from bottles on the vehicle 9. The use of an inert gas has the advantage that the device of the invention can be used in explosion endangered environments, as such a gas is substantially not liable to chemical reactions. The gas used for inflating the balloon may however also be any other gas lighter than air known to the person skilled in the art.

Preferably, a smaller balloon (not shown) is connected to the balloon 1 by means of a rope. This smaller balloon is helpful in determining the direction of the wind and as such in maneuvering the balloon 1.

The device according to the invention, shown in FIGS. 1–3 is preferably operated as follows, for example for evacuating persons from a building on fire. The vehicle 9 is driven to a secure location 3 near the building, but preferably at a certain distance from the side wall of the building. Then, the balloon 1 is inflated, a fireman takes place on the transport means 7 and the balloon is let up by veering the cable 2. During this first ascent of the balloon, the balloon 1 is in a fixed relationship with the cable 2, which can for example be obtained by means of the brake on the wheel 10 or by providing a stop or knot (not shown) on the cable. The balloon 1 is guided to the evacuating location 4 by operating the propellers 5 and the guide wires 6 during ascent of the balloon 1. Once the evacuating location 4 is reached, the fireman gains access to the building, for example by breaking a window with a hammer. The firemen then installs a prop 16 on the evacuating location 4, for example between the floor and the ceiling of the storey of the building on which he is located. He then connects the cable 2 to the prop. At this point, evacuation of persons from the evacuating location can start. This is conducted by placing a number of persons 8 on the transport means 7, for example by closing the belts 13 underneath the armpits of the persons 8 as shown in FIG. 2, after which the brake is released, so that the balloon 1 descends along the cable 2 as a result of the weight put on the balloon being larger than the lifting force of the gas. As the balloon 1 can now travel along the cable 2, substantially no steering is required during descent of the balloon 1. Once the balloon has reached the secure location 3, the persons 8 are removed from the transport means 7, after which the balloon 1 is ready to ascend back to the evacuating location 4, so that more persons can be evacuated.

During the first ascent, preferably only a single fireman is placed on the transport means. In this way, a quick ascent can be ensured, so that the fireman arrives at the evacuating location after only a short period of time. Preferably, this first fireman remains at the evacuating location to assist the persons to be evacuated in taking place on the transport means 7. In this way the whole of the transport means 7 is vacated for evacuating persons. During the second ascent, preferably a second fireman is transported to the evacuating location 4. This second fireman can also assist the persons 8 in taking place on the transport means 7.

When the number of persons 8 on the transport means 7 is below n, the balloon can also be made to descend by pulling it towards the secure location 3 with the guide wires 6, or by disconnecting the cable 2 from the evacuating location 4 and hauling it in. In this way, also the last persons 8 present on the evacuating location 4 can be evacuated with the device of the invention, even if their number is below n.

The invention claimed is:

1. Device for evacuating persons, for example from a multi-storey building on fire, from an evacuating location to a secure location, said device comprising:

a cable provided to be connected between the secure location and the evacuating location, a balloon provided to be movably mounted on said cable between the secure location and the evacuating location, guide means connected to said balloon for guiding said balloon between the secure location and the evacuating location, transport means connected to said balloon for transporting persons from the evacuating location to the secure location by movement along said cable together with said balloon, said balloon being provided to be filled with gas lighter than air for imparting an upwards lifting force to said balloon and said transport means connected thereto, said transport means being provided to carry persons up to a weight above said upwards lifting force.

2. Device according to claim 1, wherein said balloon and said transport means connected thereto are provided to descend when a number of persons on said transport means is greater than or equal to a predetermined number n.

3. Device according to claim 1, wherein the balloon is provided to be moved along the cable by means of a wheel, the wheel being provided with a brake for restricting the movement of the balloon along the cable.

4. Device according to claim 1, wherein the balloon has a flat side constructed in an inflammable material which during use is provided to remain substantially vertical and to be directed towards a side wall of a building, and that the balloon comprises a number of compartments.

5. Device according to claim 1, wherein the guide means comprise a pair of propellers located on either side of the balloon when in use.

6. Device according to claim 5, wherein the propellers are provided to be driven by means of pressurized air.

7. Device according to claim 1, wherein the guide means comprise a pair of guide wires connected to either side of the balloon when in use and each provided to be operated by a person on the ground.

8. Device according to claim 1, wherein the device further comprises a vehicle for transport to the secure location, the vehicle being provided with inflating means for inflating the balloon and a winch for rolling up or veering the cable.

9. Method of evacuating persons from an evacuating location to a secure location, comprising the steps of:

a) inflating a balloon with a gas of a density less than air, b) letting the balloon ascend by veering a cable which connects the balloon to the secure location, c) during ascent of the balloon, guiding the balloon to the evacuating location by means of guide means connected to the balloon, d) connecting the cable to the evacuating location, e) placing a number of persons on transport means connected to the balloon, the number of persons being such that the total weight of the balloon, transport means, guide means and persons is larger than the lifting force resulting from the gas in the balloon, f) transporting the persons from the evacuating location to the secure location by letting the balloon and the transport means connected thereto together descend along the cable.

10. Method according to claim 9, wherein the method further comprises the steps of:

g) removing the persons from the transport means on the secure location, h) letting the balloon ascend from the secure location to the evacuating location along the cable.

11. Method according to claim 10, wherein the method further comprises the steps of:

i) placing a number of persons on transport means connected to balloon, the number of persons being such that the total weight of the balloon, transport means, guide means and persons is larger than the lifting force resulting from the gas in the balloon, j) transporting the persons from the evacuating location to the secure location by letting the balloon descend along the cable, k) removing the persons from the transport means on the secure location, l) letting the balloon ascend from the secure location to the evacuating location along the cable.

12. Device for evacuating persons, for example from a multi-storey building on fire, from an evacuating location to a secure location, said device comprising:

a cable provided to be connected between the secure location and the evacuating location, a balloon provided to be movably mounted on said cable between the secure location and the evacuating location, guide means connected to said balloon for guiding said balloon between the secure location and the evacuating location, transport means connected to said balloon for transporting persons from the evacuating location to the secure location, said transport means being disposed at a substantially constant distance from said balloon during use, said balloon being provided to be filled with gas lighter than air for imparting an upwards lifting force to said balloon and said transport means connected thereto, said transport means being provided to carry persons up to a weight above said upwards lifting force.

13. Device according to claim 12, wherein said balloon and said transport means connected thereto are provided to descend when a number of persons on said transport means is greater than or equal to a predetermined number n.

14. Device according to claim 12, wherein the balloon is provided to be moved along the cable by means of a wheel, the wheel being provided with a brake for restricting the movement of the balloon along the cable.

15. Device according to claim 12, wherein the balloon has a flat side constructed in an inflammable material which during use is provided to remain substantially vertical and to be directed towards a side wall of a building, and that the balloon comprises a number of compartments.

16. Device according to claim 12, wherein the guide means comprise a pair of propellers located on either side of the balloon when in use.

17. Device according to claim 16, wherein the propellers are provided to be driven by means of pressurized air.

18. Device according to claim 12, wherein the guide means comprise a pair of guide wires connected to either side of the balloon when in use and each provided to be operated by a person on the ground.

* * * * *